US007605829B2

(12) United States Patent
Oh

(10) Patent No.: US 7,605,829 B2
(45) Date of Patent: Oct. 20, 2009

(54) APPARATUS AND METHOD FOR CONTROLLING BRIGHTNESS LEVEL OF DISPLAY

(75) Inventor: Jang Geun Oh, Soowon-si (KR)

(73) Assignee: LG Electronics Inc., Seoul (KR)

( * ) Notice: Subject to any disclaimer, the term of this patent is extended or adjusted under 35 U.S.C. 154(b) by 544 days.

(21) Appl. No.: 10/896,062

(22) Filed: Jul. 22, 2004

(65) Prior Publication Data

US 2005/0017994 A1 Jan. 27, 2005

(30) Foreign Application Priority Data

Jul. 26, 2003 (KR) ..... 10-2003-0051806
Jun. 29, 2004 (KR) ..... 2004/49350

(51) Int. Cl.
*G09G 5/10* (2006.01)
*G09G 5/00* (2006.01)

(52) U.S. Cl. ..... 345/690; 345/594

(58) Field of Classification Search ..... 345/690–693, 345/594, 102

See application file for complete search history.

(56) References Cited

U.S. PATENT DOCUMENTS 5,428,739 A * 6/1995 Maeda ..... 345/594
5,654,743 A 8/1997 Hu et al.
5,818,172 A * 10/1998 Lee ..... 315/86
6,198,234 B1 * 3/2001 Henry ..... 315/291
6,476,821 B2 * 11/2002 Sawada et al. ..... 345/620
2002/0175946 A1 * 11/2002 Sakuta et al. ..... 345/778
2004/0130555 A1 * 7/2004 Ko et al. ..... 345/589
2006/0290710 A1 * 12/2006 Zwanenburg ..... 345/594

FOREIGN PATENT DOCUMENTS

| | | | |
|---|---|---|---|
| CN | 1144341 | | 3/1997 |
| EP | 0 856 829 | A2 | 8/1998 |
| EP | 1 256 923 | A2 | 11/2002 |
| JP | 8213182 | | 8/1996 |
| JP | 11-296338 | A | 10/1999 |
| JP | 2001-154642 | | 6/2001 |
| JP | 2002-278522 | | 9/2002 |
| TW | 244633 | | 4/1995 |
| TW | 507159 | | 10/2002 |

OTHER PUBLICATIONS

Japanese Office Action dated Jan. 9, 2009.

* cited by examiner

*Primary Examiner*—Amr Awad
*Assistant Examiner*—Randal Willis
(74) *Attorney, Agent, or Firm*—KED & Associates, LLP

(57) ABSTRACT

A novel apparatus and method for controlling a brightness level of a display, which includes controlling the brightness level of the display based on a brightness level set for an application program.

41 Claims, 10 Drawing Sheets

Fig.4

LCD_Brightness_Level_Setting_Mode

| Application Program | Level |
|---|---|
| Music | 1 |
| Word Processor | 3 |
| Internet | 5 |
| Game | 7 |
| Movie | 9 |

| | | | |
|---|---|---|---|
| Further Application Program 1 | | Browse | Level Input |
| Further Application Program 2 | | Browse | Level Input |

| | | |
|---|---|---|
| Auto Control Mode | ✓YES | NO |
| Full Window | ✓YES | NO |
| Battery Mode | ✓YES | NO |

Fig.5

LCD_Brightness_Level_Control_Information

| Application Program | Level |
|---|---|
| Music | 1 |
| Word Processor | 4 |
| Internet | 5 |
| Game | 8 |
| Movie | 9 |
| EBS | 10 |
| ⋮ | ⋮ |

APPARATUS AND METHOD FOR CONTROLLING BRIGHTNESS LEVEL OF DISPLAY

CROSS-REFERENCE TO A RELATED APPLICATION

This application claims priority to Korean patent application No. 2003-51806, filed on Jul. 26, 2003 and 2004-49350, filed on Jun. 29, 2004, the entire contents of which are hereby incorporated in their entirety.

BACKGROUND OF THE INVENTION

1. Field of the Invention

The present invention relates to an apparatus and method for controlling a brightness level of a display based on a currently operated application program.

2. Background of the Related Art

As shown in FIG. 1, a general computer includes a Liquid Crystal Display (LCD) 19. There are several different types of LCDs, each having their own inherent optical characteristics. For example, one type of LCD uses a light emitting element such as a Cold Cathode Fluorescence Lamp (CCFL).

In more detail, FIG. 2 illustrate a notebook computer including the LCD 19 with a light emitting element 190 (e.g., a CCFL) installed at a lower portion of the display (note the CCFL 190 may be mounted at other positions of the display such as a top portion of the display). As shown in FIG. 2, the notebook computer also includes a power supply 30 for converting a power from a battery 31 or a power from an AC adapter 32 into a predetermined voltage level and for supplying the converted power to the LCD 19; and an inverter 33 for switching the power based on a Pulse Width Modulation (PWM) signal and for applying the switched power to the light emitting element 190. The notebook computer in FIG. 2 also includes a microcomputer 20, keyboard 21 and CMOS-RAM 180.

Further, a user of the notebook computer may adjust a brightness level of the LCD 19 using an input device such as a keyboard, for example. When the user adjusts the brightness level of the LCD 19, the microcomputer 20 appropriately increases or decreases the brightness level by varying the PWM signal applied to the inverter 33.

However, once the user sets the brightness level of the LCD 19, the brightness level is maintained at that level until the user again changes the brightness level.

SUMMARY OF THE INVENTION

Accordingly, one object of the present invention is to at least address the above noted and other problems and/or disadvantages.

Another object of the present invention is to allow a user to set, change or add a brightness level of a display based on one or more application programs.

Yet another object of the present invention is to automatically set, change or add a brightness level of a display based on one or more application programs.

To achieve at least the above and other objects in whole or in parts, the present invention provides a novel apparatus and method for controlling a brightness level of a display, which includes controlling the brightness level of the display based on a brightness level set for an application program.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIG. 4 is a display window illustrating a menu screen for setting a brightness level of an LCD according to the present invention;

FIG. 5 is an overview illustrating a menu for storing, changing and adding brightness level information for the LCD according to the present invention;

BEST MODE OF THE INVENTION

Figure 1:
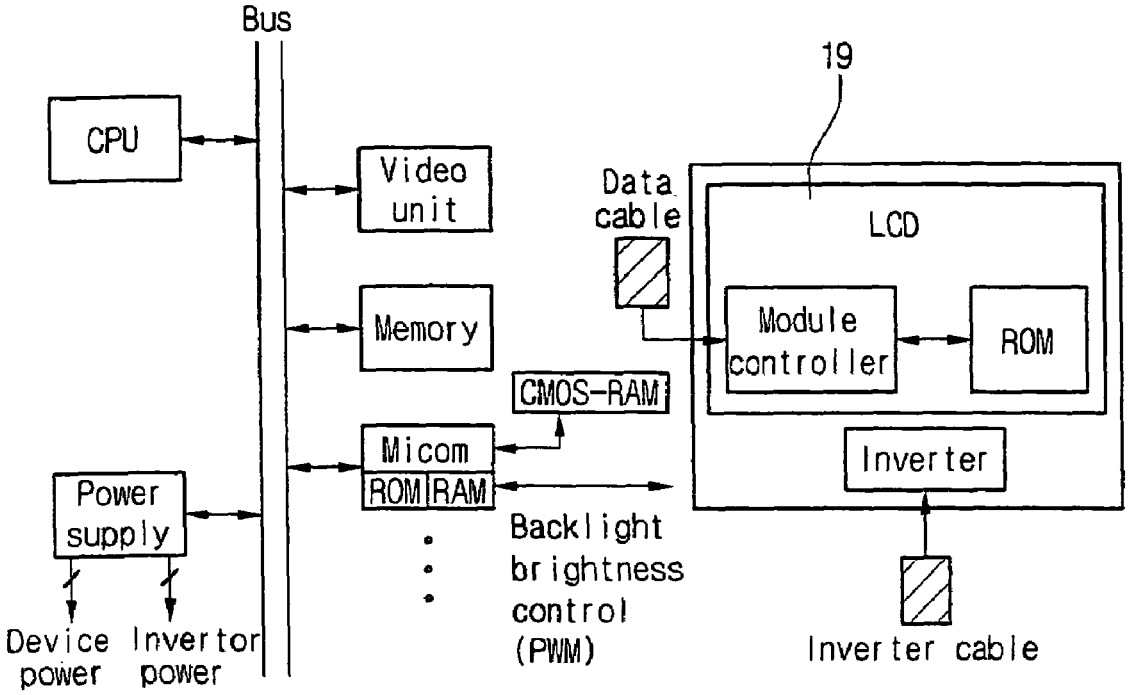
Fig.1 Related Art
FIG. 1 is a block diagram illustrating a general computer including an LCD.
Figure 2:
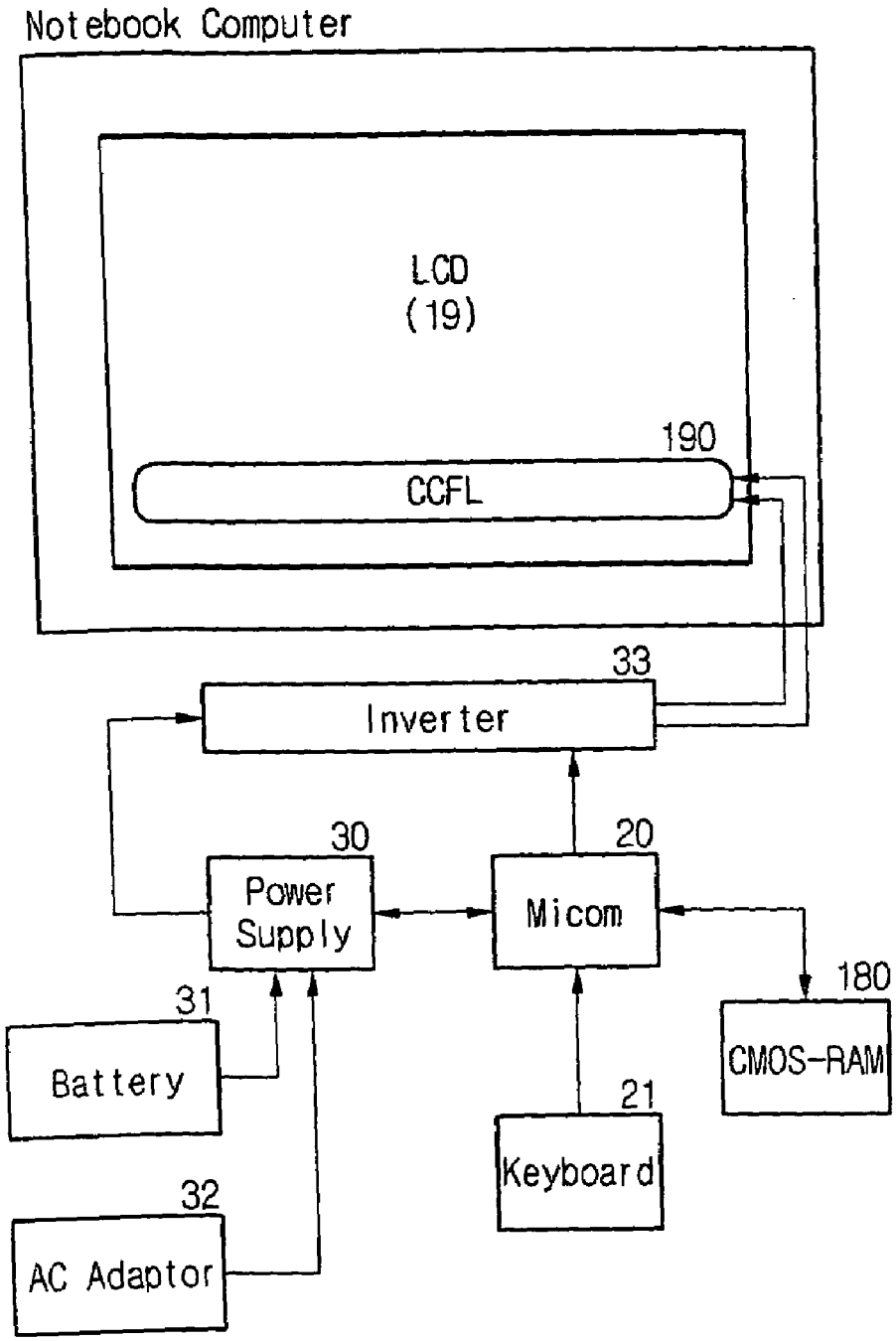
Fig.2 Related Art
FIG. 2 is a block diagram illustrating an apparatus for controlling a brightness level of the LCD in FIG. 1.

Referring now to the drawings, wherein like reference numerals designate identical or corresponding parts throughout the several views, the present invention will be described.

Figure 3:
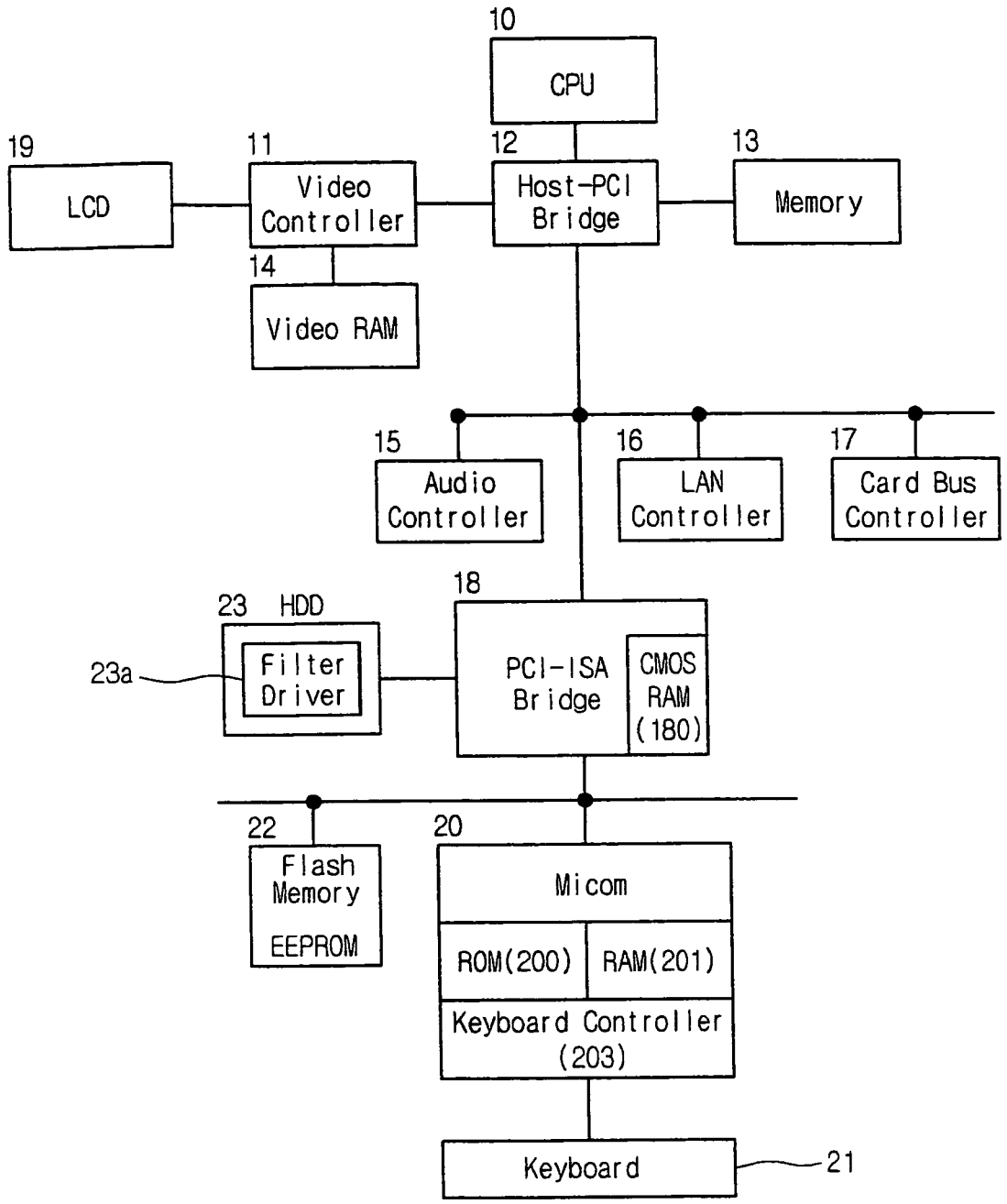
FIG. 3 is a block diagram illustrating a computer including a memory and a filter driver according to the present invention.

FIG. 3 is a block diagram illustrating a computer including a Central Processing Unit (CPU) 10, a video controller 11, a host-PCI bridge 12, a video RAM 14, an audio controller 15, a LAN controller 16, a card bus controller 17, a PCI-ISA bridge 18, the LCD 19, the microcomputer 20, the keyboard 21, a memory 13 for storing, in the form of binary data, brightness level information corresponding to application programs whose brightness levels are changed or added by the user, and a filter driver 23*a* for searching active application programs.

The filter driver 23*a* may be a computer program product stored in a Hard Disk Drive (HDD) 23 (see FIG. 3), and which is then loaded into the memory 13 and operated after a windows Operating System (OS) has been booted. Further, the PCI-ISA bridge 18 includes a CMOS-RAM. 180, and the microcomputer 20 includes a ROM 200, a RAM 201 and a keyboard controller 203. The technical explanations of the filter driver 23*a* are disclosed in Korea Patent Application No. 2002-066828 and its corresponding U.S. patent application Ser. No. 10/630,701, both of which are hereby incorporated in their entirety.

In addition, the filter driver 23*a* monitors an operational state of different devices associated with the computer such as a network adapter, a display adapter, a mouse, a monitor, a disc driver, etc. and also adds, correct, extends, etc. functions of a device driver included in the computer.

Turning now to FIG. 4, which illustrates a Graphical User Interface (GUI) such as a menu screen that allows a user to change, set or add brightness level information of the LCD for different application programs. The user may also browse (search) for other applications not shown, and set an Auto Control Mode, Full Window Mode and Battery Mode.

In more detail and with reference to FIG. 4, the brightness level of a Movie program requiring a higher luminance brightness is set to be level 9, and the brightness level of a Game program is set to be level 7. That is, a relatively high brightness level is set for these application programs. On the other hand, a lower brightness level is set for the application programs using a low luminance brightness such as a Music program or a Word Processor program. That is, as shown in FIG. 4, the brightness level for the Music application program is set to be level 1 and the brightness level of the Word Processing application program is set to be level 3. In addition, an intermediate brightness level of 5, for example, is set to be level 5 for an Internet program requiring a normal luminance brightness.

Further, the different brightness levels may be set or changed by the user for each application program, and/or may be automatically set or changed based on a state of the computer (e.g., an idle state, etc.). For example, in FIG. 4, the Movie program is set to be level 9, but can be changed to a level 10 or any other brightness level by the user typing over the existing brightness level.

In more detail, FIG. 5 illustrates the brightness level of the Word Processor application program being changed from a level 3 to a level 4, and the brightness level of the Game application being changed from a level 7 to a level 8. FIG. 5 also illustrates the addition of a new application program (the Educational Broadcasting System (EBS) for students) and a corresponding brightness level being set to a level 10.

In addition, the different brightness levels changed or added by the user may be stored in the memory 13 (see FIG. 3) when the OS is first enabled, and then stored in the HDD 23 when the OS is disabled. The different brightness levels may also be stored and managed in a nonvolatile memory, for example, an EEPROM or the flash memory 22, or stored in the ROM 200 of the microcomputer 20.

In addition, according to the present invention, the filter driver 23*a* determines which window among one or more currently-executed windows is a foreground window, and then controls the corresponding display brightness level based on the brightness level set by the user. In one example, the filter driver 23*a* may determine which window is the foreground window using the following function:

BOOL SetForegroundWindow( );

Return Value

Nonzero if the function is successful; otherwise 0.

Thus, in this example, if the return value is nonzero, the filter driver 23*a* determines the active window is the foreground window. Alternatively, if the return value is zero, the filter driver 23*a* determines the active window is not a foreground window (e.g., rather the active window is a background window). In addition, each application program executes a function to be a foreground window such that the filter driver 23*a* can determined which window is the foreground window.

Figure 6A:
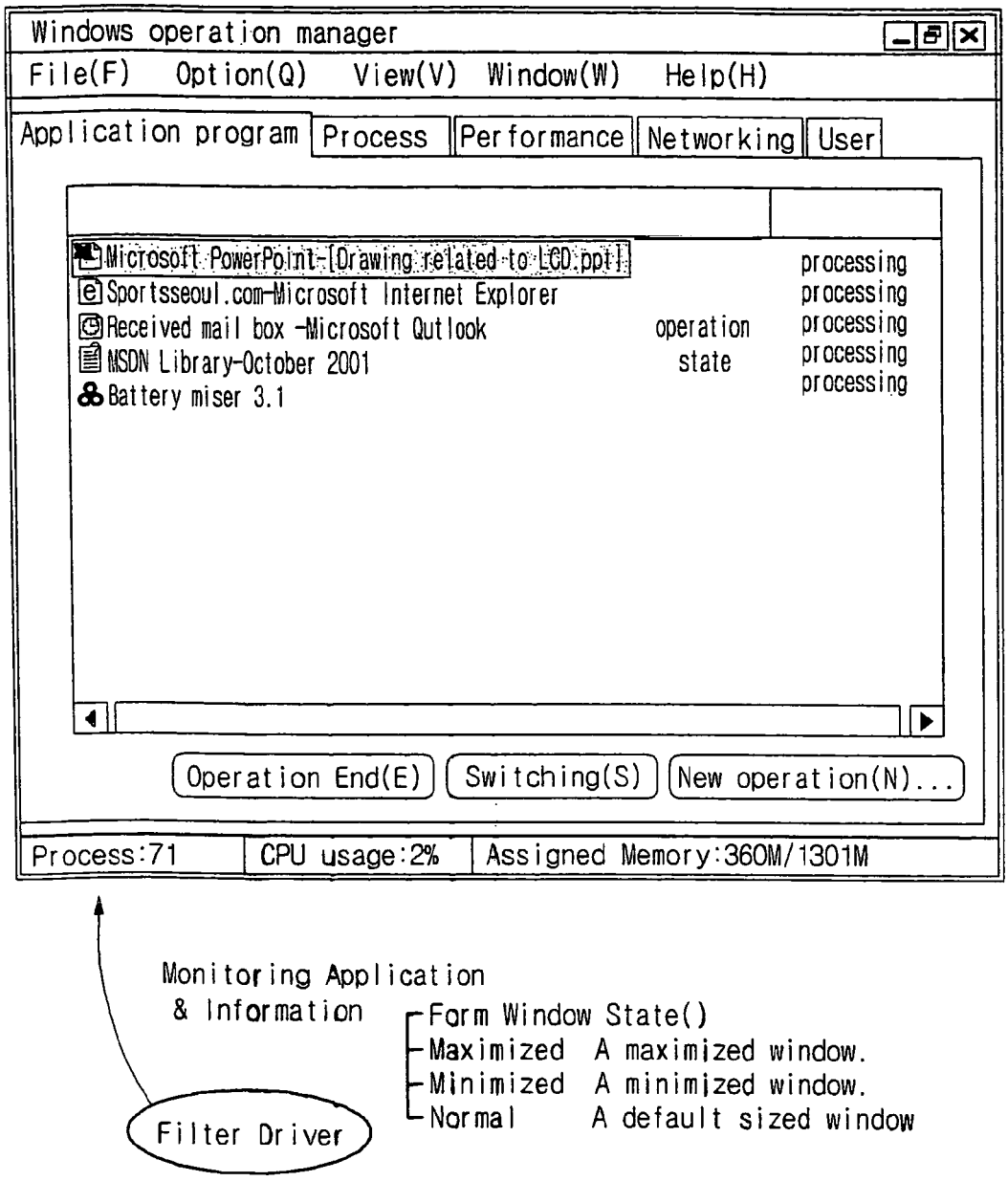
FIG. 6A is a display window illustrating different types of active application programs and whether an application is being displayed in a fill window and a foreground window.

Turning next to FIG. 6A, which illustrates a Graphical User Interface (GUI) listing several application programs that are in an active state (e.g., that are currently being executed). The GUI is also configured to display which of the currently-executed application programs is displayed in a full window, and which of the application programs is displayed in a foreground window.

Further, the currently-operated application programs can be recognized by displaying an execution file name, for example. That is, as shown in FIG. 6A, a Microsoft PowerPoint presentation is being operated, a "sportsseoul.com" Internet application program is being operated, etc., which are displayed based on the execution file name.

The filter driver 23*a* also determines which of the currently-executed application programs is displayed in a full window or a sub window (e.g., whether or not the current window is maximized) by monitoring a window size state of each application program. For example, the following window states may be used to determine whether the window is a full-window or a sub-window:

Form window states:

1)Maximized: a maximized window,

2)Minimized: a minimized window, and

3)Normal: a default sized window.

Figure 6B:
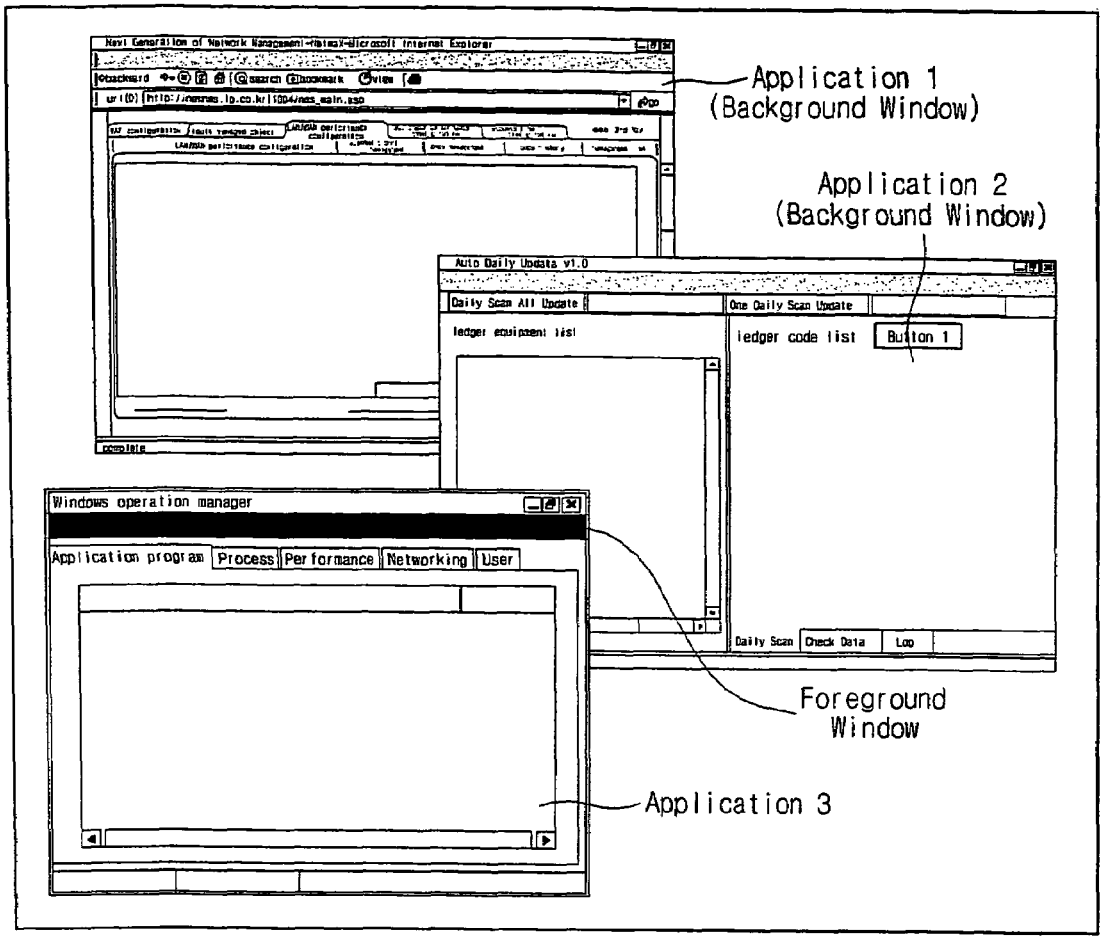
FIG. 6B is a display window illustrating application programs executed in a foreground window and in background windows.

Next, FIG. 6B is a GUI illustrating visually which window is the foreground window. As shown, the application program #3 is the foreground window. Application programs #1 and #2 are background windows.

Thus, the filter driver 23*a* according to the present invention is able to discriminate between different types of application programs, a window state corresponding to each application program, and whether or not an executed application program is being displayed in a foreground window, by using the execution files of the application programs currently executed on the Kernal of the OS, by monitoring each of the application programs, and by using the corresponding window size information.

In addition, if any of the executed application programs is not displayed in a full window as shown in FIG. 6B, the Auto Control Mode of FIG. 4 for automatically outputting the brightness levels of each application program is disabled. In this example, the brightness level of the display may be set to be the brightness level of the foreground application program (e.g., application program #3 in FIG. 6B), but may also be set by the user (for example, a background brightness level, an average brightness level, etc.).

Further, when the filter driver 23*a* determines that the currently-executed application program is displayed in a full window, the brightness level of the display is set to be the brightness level of the application program corresponding to the full window.

Figure 7:
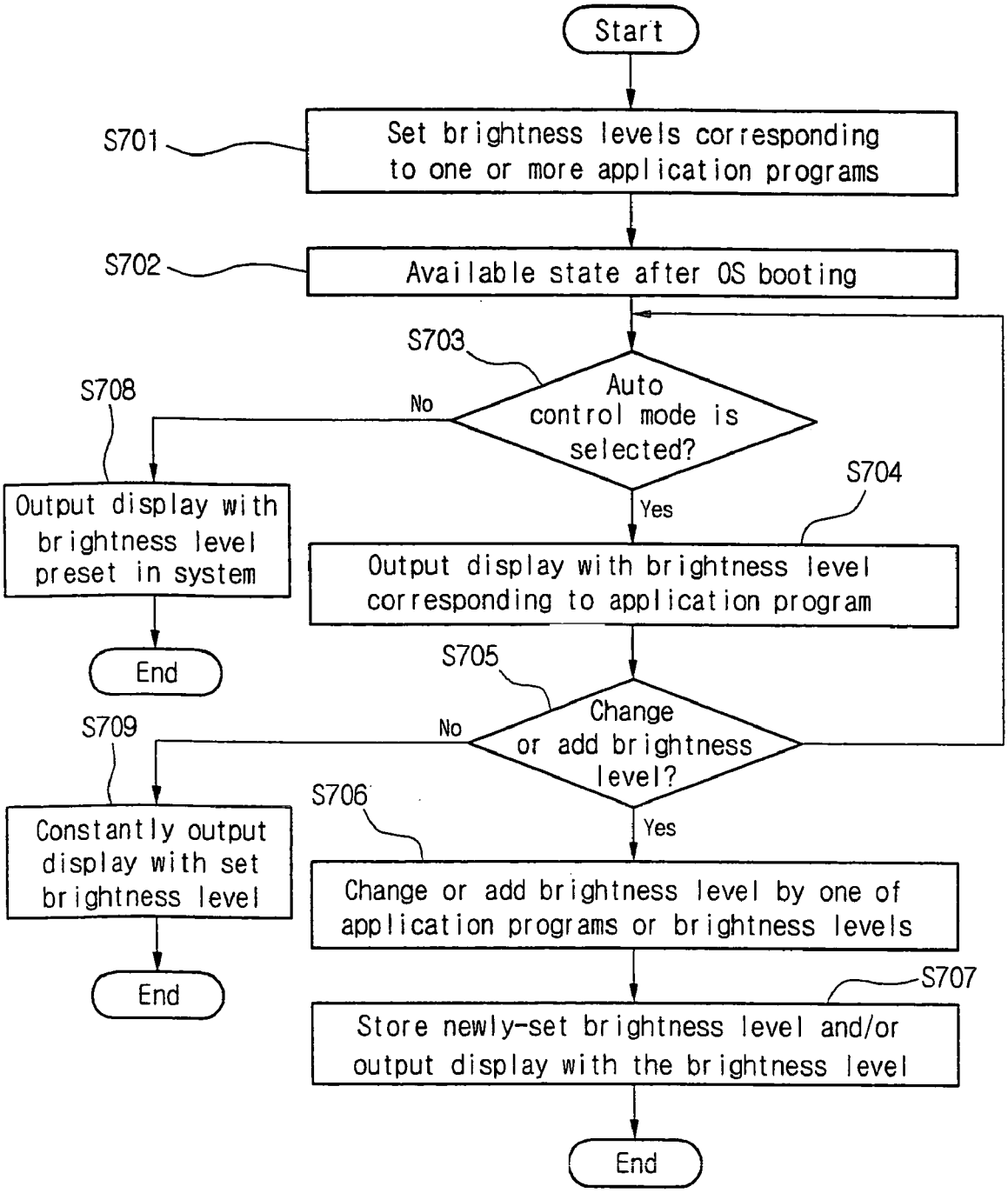
FIG. 7 is a flowchart illustrating a method for controlling the brightness level of a display according to the present invention.

Turning now to FIG. 7, which is a flowchart illustrating a method for controlling the brightness level of the display according to the present invention. As shown, the brightness levels corresponding to one or more application programs are set and stored in the memory 13 (step S701). The brightness levels may also be stored in the HDD 23 or the flash memory 22.

When the computer is available by turning on the system and booting the OS (step S702), and if the user selects Yes for the Auto Control Mode (see FIG. 4), the filter driver 23*a* determines which application programs are currently being executed and displays the currently-executed application programs with their currently set brightness levels (steps S703 and S704). See also FIGS. 4 and 5.

Further, if the user does not set the Auto Control Mode (No in step S703), the display is set to use a preset brightness level (step S708). Also, if the user wants to change or add a brightness level of a corresponding application program (step S705), the user may change the level by directly clicking the currently-registered brightness level on the menu screen and type over the currently-registered value with a new value.

The user may also add a new program by selecting a browse button (see FIG. 4) to search for a program, selecting the corresponding execution file, and then inputting a brightness level suitable for the selected application program. In this instance, the program and corresponding brightness level is added to a program list for automatic brightness control (step S706).

If the user does not want to change or add a current brightness level (No in step S705), the brightness level of the display is maintained at the previously set brightness level (step S709). Further, the brightness level newly set in step S706 may be stored in the memory 13 and/or the brightness level of the display may be set to be the brightness level set in step S706 (step S707).

As noted above, the user may change or add brightness levels for different application programs. However, the current brightness level may be also changed or added: (1) when the system transitions to an idle state or a measured CPU quantity is smaller than a preset value (in this instance the brightness level can be automatically changed); and (2) the currently-set brightness level can be changed based on a window size.

Figure 8:
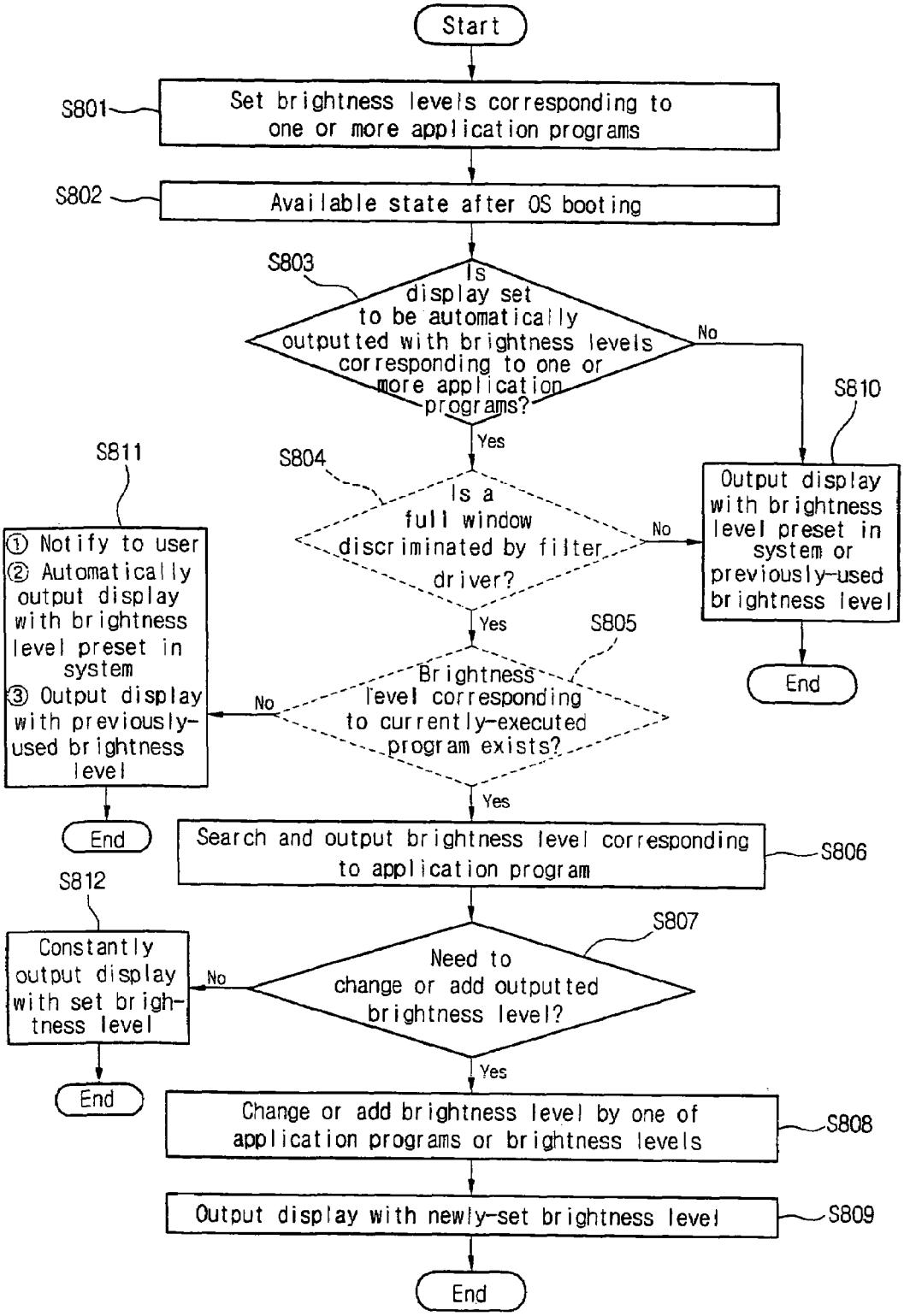
FIG. 8 is a flowchart illustrating another method for controlling the brightness level of the display according to the present invention.

Next, FIG. 8 is a flowchart illustrating another method for controlling the brightness level of the display according to the present invention. Steps S801 and S802 are the same as Steps S701 and S702 in FIG. 7 and thus are not repeated here.

In addition, if Auto Control Mode and the Full Window Mode (see FIG. 4) are selected (step S803), the filter driver 23*a* determines whether or not the window of the currently-executed application program is a full window, and whether or not the corresponding brightness level exists in the memory 13 (steps S804 and S805). If the corresponding brightness level exists in the memory 13 (Yes in step S805), the display is set to use the corresponding brightness level (step S806).

Further, if the user wants to change the brightness level of the application program executed by the above procedure or add a new brightness level (step S807), the user may change the level by directly clicking the currently-registered brightness level on the menu screen shown in FIG. 4. For example, when the brightness level of the game is level 7, the user can change it to level 10 by clicking 7 and inputting 10. As noted above, the user may also add a program by selecting the browser button and performing the related operation such that the program and corresponding brightness value are added (step S808).

When the user does not want to change the current brightness level or add a new brightness level (No in step S807), the brightness level of the display is maintained with the previously set brightness level (step S812).

Further, the brightness level newly set in step S808 may be stored in the memory or the brightness level of the display may be set to be the brightness level set in step S808 (step S809).

In addition, if the Auto Control Mode or Full Window Mode are not selected (No in steps S803 and S804), a previously set or used brightness level is used for the display (step S810). In this example, the present invention may also determine a power input mode. If the power mode is an AC power mode (namely when an adapter is connected), a higher brightness level is selected, and if the power mode is a Battery Mode, a lower brightness level is selected.

Further, when the Full Window Mode is not selected (step S803), and a plurality of windows are executed, the brightness level of the application program of the current foreground window searched by the filter driver 23*a* is used for the display (step S810).

Also, when the brightness level corresponding to the currently-executed application program is not stored in the memory 13 (No in step S805), the user is notified or the display is automatically output with a preset brightness level or a brightness level of the previously-used application program (step S811). The previous discussion of changing or adding the current brightness level has been explained above in association with FIG. 7, and thus is not repeated.

In addition, the filter driver 23*a* or the microcomputer 20 can determine whether or not the user has selected the Auto Control Mode, Full Window Mode or Battery Mode in FIG. 4. As shown in FIG. 4, the different modes may be selected using a menu button or may be set as a default.

In addition, when the Auto Control Mode of the brightness level has not been selected, the filter driver 23*a* or the microcomputer 20 maintains the duty of the PWM signal applied to the inverter 33, thereby maintaining the current brightness level of the LCD 19.

Conversely, when the Auto Control Mode has been selected, the filter driver 23*a* or the microcomputer 20 determines the currently-executed application program(s). When a plurality of application programs are executed, the filter driver 23*a* determines which is the foreground application program. Thereafter, the brightness level information of the LCD 19 set in association with the foreground application program is searched and read from the memory 13.

Then, the duty of the PWM signal applied to the inverter 33 is variably controlled according to the searched and read brightness level information of the LCD 19 set in association with the foreground application program. Thus, it is possible to variably control the brightness of the LCD 19.

For example, when the foreground application program is the Movie program (see FIG. 5), the duty of the PWM signal applied to the inverter 33 is variably controlled according to the high brightness level information (for example, level 9). Therefore, the brightness of the LCD 19 is set to be higher.

However, when the foreground application program is the Music program, the duty of the PWM signal applied to the inverter 33 is variably controlled according to a low brightness level information (for example, level 1). Thus, the brightness of the LCD 19 is set to be lower. In addition, in this instance, when the current power mode is a Battery Mode (which can be selected in the GUI of FIG. 4), the filter driver 23*a* or the microcomputer 20 performs the above-noted brightness level control operations. However, when the current power mode is an AC power mode, the brightness level control operations are omitted so as to increase the use time of the battery and prevent the brightness of the LCD 19 from being unnecessarily changed.

That is, the Auto Control Mode can be set for the Battery Mode and the Full Window Mode.

Figure 9:
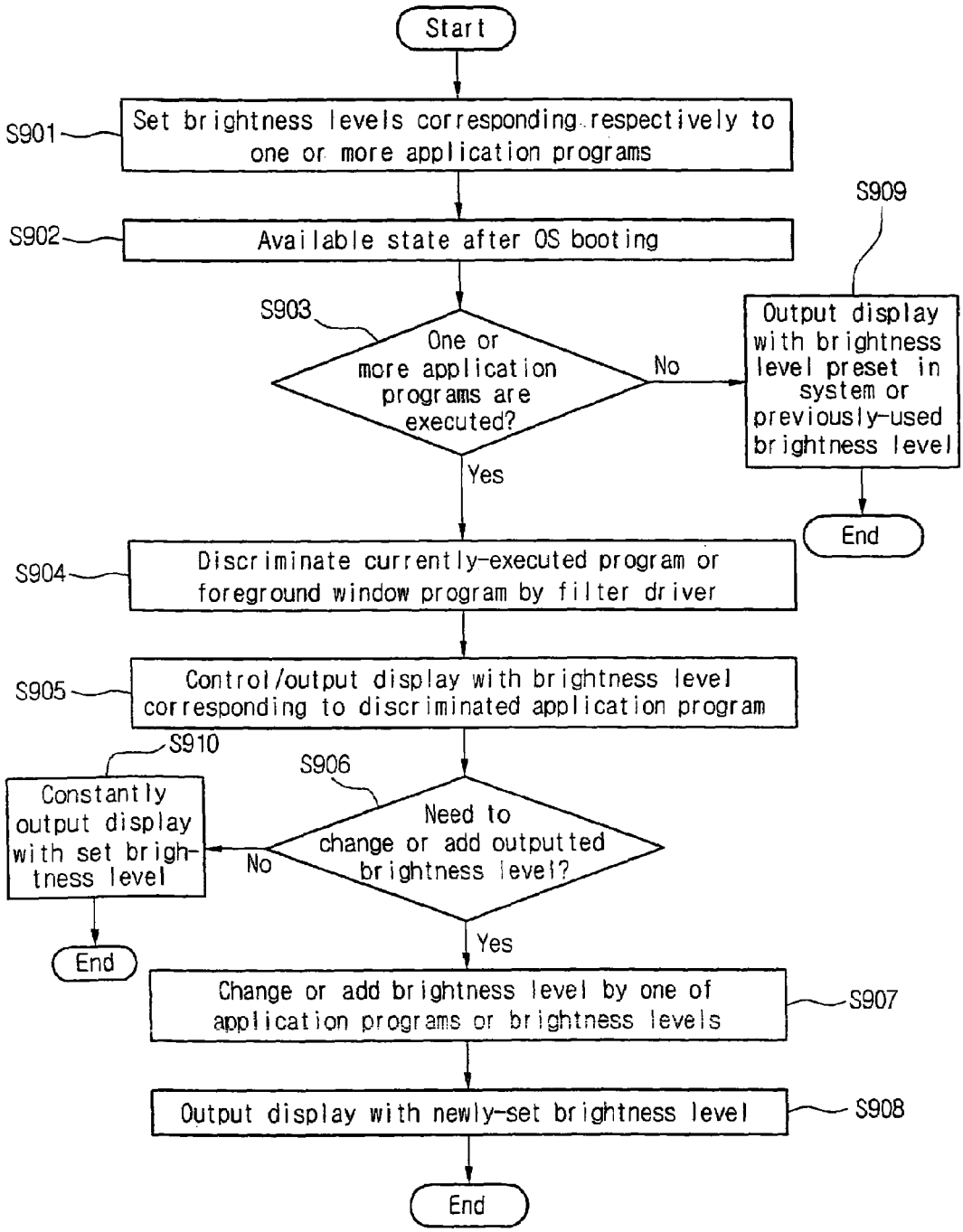
FIG. 9 is a flowchart illustrating yet another method for controlling the brightness level of the display according the present invention.

Turning now to FIG. 9, which is a flowchart showing another method for controlling the brightness level of the display according to the present invention.

Steps S901 and S902 are similar to the steps S701 and S702 in FIG. 7 and thus are not repeated here. Further, when one or more application programs are executed (Yes in step S903), the filter driver 23*a* determines the currently-executed application program or the foreground window program, and the brightness level of the display is set to be the brightness level of the corresponding discriminated application program (steps S904 and S905). Steps S906, S907, S908 S909 and S910 are similar to the steps S807, S808, S809, S909 and S812 in FIG. 8, and thus are not repeated here.

FIG. 5 illustrates an example of results obtained with the methods shown in FIGS. 7-9.

As discussed earlier, according to the present invention, the brightness level of the display may also automatically be controlled based on currently executed application program.

According to the present invention, the executed application program can be displayed with the most appropriate brightness level for the user, and the battery can be used for an extended period of time without unnecessary power consumption.

The present invention was discussed above with respect to the LCD being included with a notebook computer. However, the present invention is also applicable to other devices having displays such as a Personal Digital Assistance (PDA), Set-top box and Telematrix, etc.

This invention may be conveniently implemented using a conventional general purpose digital computer or microprocessor programmed according to the teachings of the present specification, as well be apparent to those skilled in the computer art. Appropriate software coding can readily be prepared by skilled programmers based on the teachings of the present disclosure, as will be apparent to those skilled in the software art.

The invention may also be implemented by the preparation of application specific integrated circuits or by interconnecting an appropriate network of conventional component circuits, as will be readily apparent to those skilled in the art. The present invention includes a computer program product which is a storage medium including instructions which can be used to program a computer to perform a process of the invention. The storage medium can include, but is not limited to, any type of disk including floppy disks, optical discs, CD-ROMs, and magneto-optical disks, ROMs, RAMs, EPROMs, EEPROMs, magnetic or optical cards, or any type of media suitable for storing electronic instructions.

What is claimed is:

1. An apparatus for controlling a brightness level of a display, comprising:

a controller configured to control the brightness level of the display based on a brightness level set for an application program; and a Graphic User Interface (GUI) to simultaneously display information of currently-executed application programs and their corresponding set brightness levels, wherein the controller controls the brightness level of the display to be a lower brightness level among a plurality of the brightness levels for each application program when a power mode to be used is determined to be a battery power mode, and the controller controls the brightness level of the display to be a higher brightness level among the plurality of a brightness levels for each application program when the power mode to be used is determined to be an AC power mode, wherein when the currently-executed application program is not in a full window, the brightness level of the display is controlled based on a brightness of only a foreground window detected by a filter driver of the controller, and wherein even though an Auto Control mode and a foreground application program are set, the brightness level control operation is omitted when the current power mode is the AC power mode.

2. The apparatus of claim 1, further comprising:

a memory configured to store corresponding brightness levels for different application programs.

3. The apparatus of claim 1, wherein the Graphic User Interface (GUI) is configured to change an existing brightness level of a corresponding application program or to add a new application program and a corresponding brightness level for the new application program.

4. The apparatus of claim 1, wherein the controller comprises a filter driver or a microcomputer configured to control the brightness level of the display.

5. The apparatus of claim 1, wherein the controller controls the brightness level of the display by adjusting a duty of a Pulse Width Modulation (PWM) signal applied to the display based on the brightness level set for the application program.

6. The apparatus of claim 1, wherein the controller searches for the currently-executed application programs, determines which currently-executed application program is displayed in at least one of the full window or the foreground window, and controls the brightness level of the display to be the brightness level set for the currently-executed application program displayed in the foreground window.

7. The apparatus of claim 6, wherein the controller determines the currently-executed application program displayed in the foreground window by monitoring a function of BOOL SetForegroundWindow( ).

8. The apparatus of claim 6, wherein the controller determines the currently-executed application program displayed in the full window by monitoring a Form window state ( ).

9. The apparatus of claim 1, wherein the Graphic User Interface (GUI) includes an Auto Control Mode button, a Full Window Mode button and a Battery Mode button configured to set whether or not an Auto Control Mode, a Full Window Mode and a Battery Mode are to be executed respectively, wherein when the Battery Mode is selected, the controller determines if a power mode of the display is the AC power mode or is the battery power mode, and the controller controls the brightness level of the display to be a lower brightness level when the power mode is determined to be the battery power mode and the controller controls the brightness level of the display to be a higher brightness level when the power mode is determined to be the AC power mode.

10. The apparatus of claim 9, wherein when the Auto Control Mode is selected, the controller controls the brightness level of the display to be the brightness level set for the application program, and wherein when the Auto Control Mode and the Full Window Mode are selected, the controller searches for the currently-executed application programs, determines which currently-executed application program is displayed in a full window, determines whether a brightness level exists for the currently-executed application program and controls the brightness level of the display to be the brightness level set for the currently-executed application program displayed in the full window.

11. The apparatus of claim 10, wherein when the controller determines the brightness level does not exist for the currently-executed application program, the controller notifies a user that the brightness level does not exist.

12. The apparatus of claim 9, wherein when the Battery Mode is selected, the controller determines if a power mode of the display is the AC power mode or the battery power mode, and the controller controls the brightness level of the display to be the lower brightness level among the plurality of the brightness levels for each application program when the power mode is determined to be the battery power mode and the controller controls the brightness level of the display to be the higher brightness level among the plurality of the brightness levels for each application program when the power mode is determined to be the AC power mode.

13. The apparatus of claim 9, wherein when the Auto Control Mode is not selected, the controller controls the brightness level of the display to be a previously set brightness level.

14. The apparatus of claim 9, wherein the Auto Control mode is set when the Battery Mode and the Full Window Mode are selected.

15. The apparatus of claim 9, wherein the Auto Control Mode for automatically outputting the brightness levels of each application program is disabled when any of the executed application programs is not displayed in a full window.

16. The apparatus of claim 1, further comprising a memory to store a brightness level changed or added by a user when an Operating System (OS) is first enabled, and the brightness level is then stored in a Hard Disk Drive (HDD) when the OS is disabled.

17. The apparatus of claim 1, wherein the brightness level set for the application program is changed on a window size.

18. The apparatus of claim 1, wherein in case that the corresponding brightness level for the currently-executed application program does not exist, the controller controls the brightness level of the display to be at least one of a previously set brightness level for the display or a previously used program brightness level.

19. A method for controlling a brightness level of a display, comprising:

displaying an Auto Control button on the display to select an Auto Control mode in which a first brightness level previously input by a user is used;

controlling the brightness level of the display for an application program based on the first brightness level corresponding to a currently executed program among each of a plurality of brightness levels set respectively by the user for a plurality of application programs when the displayed Auto Control button has been selected by the user, wherein when the user selects Yes for the Auto Control Mode, the first brightness level corresponding to a currently-executed respective application programs is displayed;

controlling the brightness level of the display for an application program based on a second brightness level preset by the user regardless of the currently executed application program when the displayed Auto Control button has not been selected; and changing an existing brightness level of a corresponding application program or adding a new application program and a corresponding brightness level for the new application program, and wherein in case that the corresponding brightness level for the new application program does not exist, the new application program is searched using a browse button on a Graphic User Interface (GUI) and the corresponding brightness level for the new searched application program is added to a program list for automatic brightness control.

20. The method of claim 19, further comprising:

storing corresponding brightness levels for different application programs.

21. The method of claim 19, further comprising:

displaying a plurality of currently-executed application programs and their corresponding set brightness levels.

22. The method of claim 19, wherein controlling the brightness level utilizes a filter driver or a microcomputer to control the brightness level of the display.

23. The method of claim 19, wherein controlling the brightness level based on the first brightness level controls the brightness level of the display by adjusting a duty of a Pulse Width Modulation (PWM) signal applied to the display based on the brightness level set for the application program.

24. The method of claim 19, further comprising:

searching for currently-executed application programs;

determining which currently-executed application program is displayed in a full window or a foreground window; and controlling the brightness level of the display to be the brightness level set for the currently-executed application program displayed in the full window or the foreground window.

25. The method of claim 24, wherein determining which currently-executed application program is displayed in the foreground window is performed by monitoring a function of BOOL SetForegroundWindow( ).

26. The method of claim 19, further comprising:

displaying the Auto Control Mode button and a Full Window Mode button and a Battery Mode button to select whether or not an Auto Control Mode, a Full Window Mode and a Battery Mode are to be executed, respectively.

27. The method of claim 26, wherein when the Auto Control Mode is selected, controlling the brightness level based on the first brightness level controls the brightness level of the display to be the brightness level set for the application program, and wherein when the Auto Control Mode and the Full Window Mode are selected, controlling the brightness level based on the first brightness level searches for currently-executed application programs, determines which currently-executed application program is displayed in a full window, determines whether a brightness level exists for the currently-executed application program and controls the brightness level of the display to be the brightness level set for the currently-executed application program displayed in the full window.

28. The method of claim 27, wherein when controlling the brightness level determines the brightness level does not exist for the currently-executed application program, the method further comprises notifying a user that the brightness level does not exist and controlling the brightness level of the display to be a preset brightness level.

29. The method of claim 26, wherein when the Battery Mode is selected, the method further comprises:

determining when a power mode of the display is an AC power mode or a battery power mode; and controlling the brightness level of the display to be a lower brightness level when the power mode is determined to be the battery power mode and controlling the brightness level of the display to be a higher brightness level when the power mode is determined to be the AC power mode.

30. The method of claim 19, further comprising a filter driver to determine which application programs are currently being executed and to display the currently-executed application programs with theft currently set respective brightness levels when a user selects Yes for the Auto Control Mode.

31. The method of claim 19, wherein the brightness level set for the application program is changed on a window size.

32. The method of claim 19, wherein in case that the corresponding brightness level for the currently-executed application program does not exist, the controller controls the brightness level of the display to be at least one of a previously set brightness level for the display or a previously used program brightness level.

33. A method for controlling brightness levels of a display, comprising:

displaying a Graphical User Interface (GUI) providing names of application programs and corresponding brightness levels for each of the application programs;

changing a brightness level of one of the application programs displayed by the GUI;

displaying a window having the one application program being executed and displayed at the changed brightness; and adding a new application program and a corresponding brightness level for the new application program to the GUI, and displaying the new application program at the corresponding brightness level, and wherein in case that the corresponding brightness level for the new application program does not exist, the program is searched using a browse button on the Graphic User Interface (GUI) and the corresponding brightness level for the new searched application program is added to a program list for automatic brightness control.

34. The method of claim 33, wherein changing the brightness level includes searching for currently-executed application programs, determining which currently-executed application program is displayed in a full foreground window, and controlling the brightness level of the display to be the brightness level set for the currently-executed application program displayed in the full foreground window.

35. The method of claim 33, wherein the Graphic User Interface (GUI) includes an Auto Control Mode button, a Full Window Mode button and a Battery Mode button configured to select an Auto Control Mode, a Full Window Mode and a Battery Mode, respectively.

36. The method of claim 35, wherein when the Auto Control Mode is selected, the brightness level of the display is controlled to be the brightness level set for the application program, and wherein when the Auto Control Mode and the Full Window Mode are selected, changing the brightness level includes searching for currently-executed application programs, determining which currently-executed application program is displayed in a full window, determining whether a brightness level exists for the currently-executed application program and controlling the brightness level of the display to be the brightness level set for the currently-executed application program displayed in the full window.

37. The method of claim 36, wherein when the brightness level does not exist for the currently-executed application program, a user is notified that the brightness level does not exist.

38. The method of claim 35, wherein when the Battery Mode is selected, changing the brightness level includes determining when a power mode of the display is an AC power mode or a battery power mode, and controlling the brightness level of the display to be a lower brightness level when the power mode is determined to be the battery power mode and controlling the brightness level of the display to be a higher brightness level when the power mode is determined to be the AC power mode.

39. The method of claim 33, wherein when the Auto Control Mode is not selected, the brightness level of the display is controlled to be a previously set brightness level.

40. An apparatus for controlling a brightness level of a display, comprising:

a controller to control the brightness level of the display based on a brightness level set for an application program;

a Graphic User Interface (GUI) to simultaneously display information of currently-executed application programs and their corresponding set brightness levels; and a memory to store corresponding brightness levels for different application programs, wherein the controller searches for the currently-executed application programs, determines which currently-executed application program is displayed in at least one of a full window or a foreground window, and controls the brightness level of the display to be the brightness level set for the currently-executed application program displayed in the foreground window, wherein the currently-operated application programs is recognized by a filter driver based on an execution file name and in case that the corresponding brightness level for the currently-executed application program does not exist, the controller controls the brightness level of the display to be at least one of a previously set brightness level for the display or a previously used program brightness level, wherein the brightness level set for the application program is changed on a window size and in case that the corresponding brightness level for the new application program does not exist, the application program is searched using a browse button on the Graphic User Interface (GUI) and the corresponding brightness level for the new searched application program is added to a program list for automatic brightness control, wherein an Auto Control mode is set in case that a battery power mode and a Full Window Mode are selected and wherein even though the Auto Control mode and the foreground application program are set, the brightness level control operation is disabled when the current power mode is an AC power mode.

41. A method for controlling a brightness level of a display, comprising:

displaying an Auto Control button on the display to select an Auto Control mode in which a first brightness level previously input by a user is used;

controlling the brightness level of the display for an application program based on the first brightness level corresponding to a currently executed program among each of a plurality of brightness levels set respectively by the user for a plurality of application programs when the displayed Auto Control button has been selected by the user, wherein when the user selects Yes for the Auto Control Mode, the first brightness level corresponding to a currently-executed respective application programs is displayed;

controlling the brightness level of the display for an application program based on a second brightness level preset by the user regardless of the currently executed application program when the displayed Auto Control button has not been selected; and controlling searches for the currently-executed application programs, determining which currently-executed application program is displayed in at least one of a full window or a foreground window, and controlling the brightness level of the display to be the brightness level set for the currently-executed application program displayed in the foreground window, wherein the currently-operated application program is recognized by a filter driver based on an execution file name and in case that the corresponding brightness level for the currently-executed application program does not exist, a controller controls the brightness level of the display to be at least one of a previously set brightness level for the display or a previously used program brightness level, wherein the brightness level set for the application program is changed on a window size and in case that the corresponding brightness level for the new application program does not exist, the application program is searched using a browse button on the Graphic User Interface (GUI) and the corresponding brightness level for the new searched application program is added to a program list for automatic brightness control, wherein the Auto Control mode is set in case that a Battery Power Mode and a Full Window Mode are selected, and wherein even though the Auto Control mode and the foreground application program are set, the brightness level control operation is disabled when the current power mode is an AC power mode.

* * * * *